United States Patent [19]

Johnston

[11] Patent Number: 4,572,934

[45] Date of Patent: Feb. 25, 1986

[54] MERCURY SWITCH

[75] Inventor: Stephen P. Johnston, Detroit Lakes, Minn.

[73] Assignee: S. J. Electro Systems, Inc., Detroit Lakes, Minn.

[21] Appl. No.: 632,722

[22] Filed: Jul. 20, 1984

Related U.S. Application Data

[63] Continuation-in-part of Ser. No. 595,422, Mar. 30, 1984.

[51] Int. Cl.[4] ..... H01H 29/22

[52] U.S. Cl. ..... 200/222; 200/61.2; 200/190; 200/227

[58] Field of Search ..... 200/222, 190, 220, 221, 200/226, 227, 232, 235, 182, 153 A, 52 A, 61.47, 61.52, 61.2

[56] References Cited

U.S. PATENT DOCUMENTS

| | | | |
|---|---|---|---|
| 2,182,216 | 12/1939 | Staley | 200/33 A |
| 2,219,496 | 10/1940 | Staley | 200/227 |
| 2,229,990 | 1/1941 | Sateren | 200/227 |
| 2,265,681 | 12/1941 | Bear et al. | 200/226 |
| 2,269,690 | 1/1942 | Rickmeyer | 200/227 |
| 2,570,095 | 10/1951 | Bucklen, III et al. | 200/227 |
| 2,591,571 | 4/1952 | Marino | 362/394 |
| 2,823,284 | 2/1958 | Lentz et al. | 200/226 |
| 3,351,726 | 11/1967 | Cook | 200/185 |
| 4,135,067 | 1/1979 | Bitko | 200/226 |

FOREIGN PATENT DOCUMENTS

| | | | |
|---|---|---|---|
| 724947 | 5/1932 | France | 200/220 |

*Primary Examiner*—Stephen Marcus
*Assistant Examiner*—Renee S. Kidorf
*Attorney, Agent, or Firm*—Merchant, Gould, Smith, Edell, Welter & Schmidt

[57] ABSTRACT

The present invention relates to a mercury switch (10) including an outer metal housing (12) having a closed end and an open end. A baffle member (14) is positioned in the housing (12) immediate of the closed and open ends. The baffle member (14) defines a first bore (32), a second bore (34) of increasing diameter in a direction toward the open end of the housing (12), and a third bore (36). An electrode assembly (16) is partially inserted into the open end of the housing (12). The electrode assembly includes a solid electrode (40) having a stem portion (42) and a head portion (44) with a truncated conical configuration of decreasing diameter in a direction toward the closed end of the housing (12) and having a recessed surface 102 providing a mercury wetting reservoir. The baffle member (14) and the truncated conical head portion (44) cooperate to provide contact between a first supply of mercury (30*a*) and the solid electrode (40) at a location removed from an insulating member (46). The electrode assembly (16) includes a metal weld ring member (50) which is suitably secured to the housing (12).

15 Claims, 6 Drawing Figures

MERCURY SWITCH

This application is a Continuation-in-part of Ser. No. 595,422; filed Mar. 30, 1984.

BACKGROUND OF THE INVENTION

The present invention relates to a mercury switch and more particularly to a mercury switch wherein the switch housing/baffle member serves as one electrode with a second electrode suitably insulated from the housing being partially inserted into an open end of the housing.

Mercury switches are widely used to control pumps, solenoids, relays, alarms, etc. In particular, they are often used in conjunction with a float housing for detecting predetermined high or low liquid levels in sewage and drainage applications so as to activate a pump as required.

Among the many problems which must be overcome in mercury switch design is damage due to electrical arcing and contamination of the mercury supply.

The electrical arcing which occurs when an electrical circuit is made between the housing and the electrode positioned therein erodes the insulator insulating the electrode from the housing. In addition, the electrical arcing causes contamination of the mercury due to carbon and other material leaching out of the housing walls and other parts of the switch.

In addition, there are often problems with the switch reliably switching off and/or on at a particular angle of inclination. Sometimes there will not be a clean break or contact made and the switch will intermittently switch on and off for a period of time. Furthermore, the electrical arcing and corresponding heat generated thereby takes its toll on the electrode positioned in the housing and the other parts of the housing. After extended use, burnout of the electrode and/or the housing will frequently occur.

In Ser. No. 595,422, filed Mar. 30, 1984, a mercury switch solving these and many other problems associated with the prior art was disclosed.

The present invention provides a further improvement in performance over this switch.

SUMMARY OF THE PRESENT INVENTION

The present invention relates to a mercury switch including an outer metal housing having a closed end and an open end. The housing has a longitudinal axis and defines a bore extending inwardly from the open end. An electrically conductive baffle member is positioned in the housing intermediate of the closed and open ends. The baffle member defines an end facing the closed end of the housing and an end facing the open end of the housing. The baffle member defines a first bore, a second bore of increasing diameter in a direction toward the open end of the housing, and a third bore. The third bore is of greater diameter than the first bore with the second bore being positioned intermediate of the first and third bores. The first, second and third bores are contiguous so as to define a continuous pathway from the closed end of the housing toward the open end of the housing. The mercury switch further includes an electrode assembly being at least partially inserted into the bore of the housing at the open end of the housing. The electrode assembly includes a solid electrode having a stem portion and a head portion. The head portion has a substantially flat end surface which faces the closed end of the housing and has a truncated conical configuration of decreasing diameter in a direction toward the closed end of the housing. The head portion includes a rim portion which coaxially surrounds the end surface and extends axially toward said closed end of said housing. The head portion extends from the third bore of the baffle member partially into the second bore of the baffle member. The head portion is of lesser diameter than the third bore of the baffle member and that portion of the second bore into which the head portion projects. The electrode assembly further includes a resilient, insulating member circumferentially positioned around said stem portion along an axial portion thereof, the insulating member abuting the head portion and having a greater diameter than the head portion. The electrode assembly further includes a metal weld ring member positioned circumferentially about the insulating member, the metal weld ring member being fixedly interconnected to the housing. The mercury switch includes a quantity of mercury. A cavity is positioned between the closed end of the housing and the end of the baffle member facing the closed end of the housing. The cavity holds the mercury when the mercury switch is in an off position. The first bore of the baffle member is in communication with the cavity while the end of the baffle member facing the cavity has a substantially flat wall extending transversely of the housing bore and facing the cavity. The first bore and the vertical wall cooperate to enable only a portion of the mercury to flow therethrough when the mercury switch is positioned in an on position.

The present invention provides for reliable contact to be made and broken between the electrode assembly and the baffle member in the housing.

The end surface of the head portion of the electrode provides a mercury wetting reservoir wherein a quantity of mercury becomes wetted onto the end surface after a brief period of use. Accordingly, a mercury-to-mercury contact is initially provided at the electrode when moved into the on position. The initial mercury-to-mercury contact is advantageous in that it results in a low contact resistance. Additionally there is less contact bounce or intermittent contact as the cohesive nature of mercury will cause an initial solid contact to be made. There is less arcing which results in less operating heat and consequently less wear to the switch resulting in a longer useful life.

Yet another advantage is an increase in switch off reliability. The rim portion separates the mercury in the wetting reservoir from the mercury in the bore of the baffle member after the initial mercury-to-mercury contact is made. Accordingly, the mercury-to-mercury contact is broken such that when switched off, a mercury-to-metal contact is broken at the electrode. This provides for a clean break where as a mercury-to-mercury contact might cause the switch to stick in the on position.

Additionally, the baffle member cooperates with the head portion of the solid electrode to keep the mercury initial contact point on the solid electrode away from the insulating member. Since the contact arc point is some distance away from the insulating member, erosion of the insulating member is drastically reduced thereby increasing the switch life without the added cost of a ceramic arc barrier or the like.

Furthermore, the baffle member and the electrode assembly cooperate to cause a fairly large surface area of the electrode to make contact with the mercury thereby reducing burn-out time of the electrode.

The solid electrode of the present invention enables the switch to be used with higher amperage requirements as it will not burn through as readily as a hollow electrode.

Yet another feature of the present invention is that the baffle member and the electrode assembly cooperate to break the circuit at the edge of the truncated conical head portion of the solid electrode after the mercury has begun moving away from the electrode end and begins to fall through the first bore of the baffle member into the cavity at the closed end of the switch.

Since the mercury has a tendency to be cohesive, the entire collection of mercury stays together and flows into the cavity at the closed end of the housing.

The preferred embodiment of the present invention utilizes helium gas in the bores of the baffle member and the cavity of the closed end of the housing to quench the electrical arcing and absorb and distribute the heat created to minimize heat damage to parts of the switch such as the electrode assembly. The use of helium gas also reduces contamination of the mercury, thereby increasing the life of the switch. Furthermore, the mercury switch can be utilized with much larger amperage requirements.

Additionally, the first bore of the baffle member has sufficient length to establish uniform mercury flow from the cavity of the closed end of the switch to the electrode assembly. The uniformity of mercury flow enables a clean contact without chatter or intermittent connection.

The end of the baffle member facing the closed end of the switch functions as a barrier holding back the reservoir of mercury in the cavity between the baffle member and the closed end of the switch. Only a portion of the mercury drops through the baffle member when the switch is angled. This enables a variation of the "switch-on" angle depending on the amount of mercury in the cavity. This also enables the used mercury to be constantly mixed with mercury in the cavity or reservoir, thereby reducing the effects of contamination caused by multiple switching, and thus increasing the life of the switch.

Yet another feature of the present invention, is that the switch off position or angle can be varied by varying the slant or angle of incidence with respect to the longitudinal axis of the switch, of the baffle walls defining the second bore.

In the preferred embodiment of the present invention, the baffle member is plated with a chrome alloy so as to reduce the leaching of carbon from the steel thereby contaminating mercury in the switch.

Yet another feature of the present invention, is the inclusion of a collar portion at the end of the baffle member facing the open end of the switch which defines the third bore. The collar portion facilitates in positioning the baffle with respect to the electrode assembly.

In the preferred embodiment of the present invention, the electrode of the electrode assembly is a solid one piece unit.

These and various advantages and features of novelty which characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views.

DETAILED DESCRIPTION OF THE PREFERRED EMBODIMENT

Figure 2:
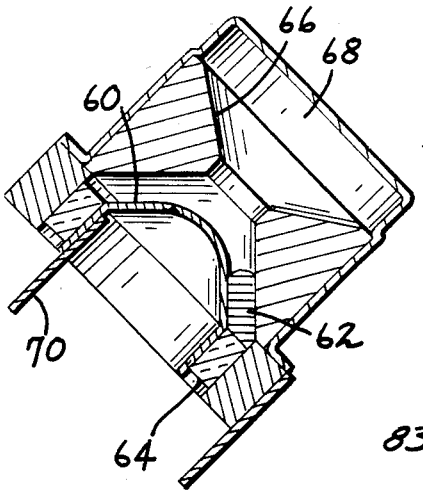
FIG. 2 PRIOR ART
FIG. 2 is a sectional view illustrating a typical embodiment of a prior art mercury switch.
Figure 1:
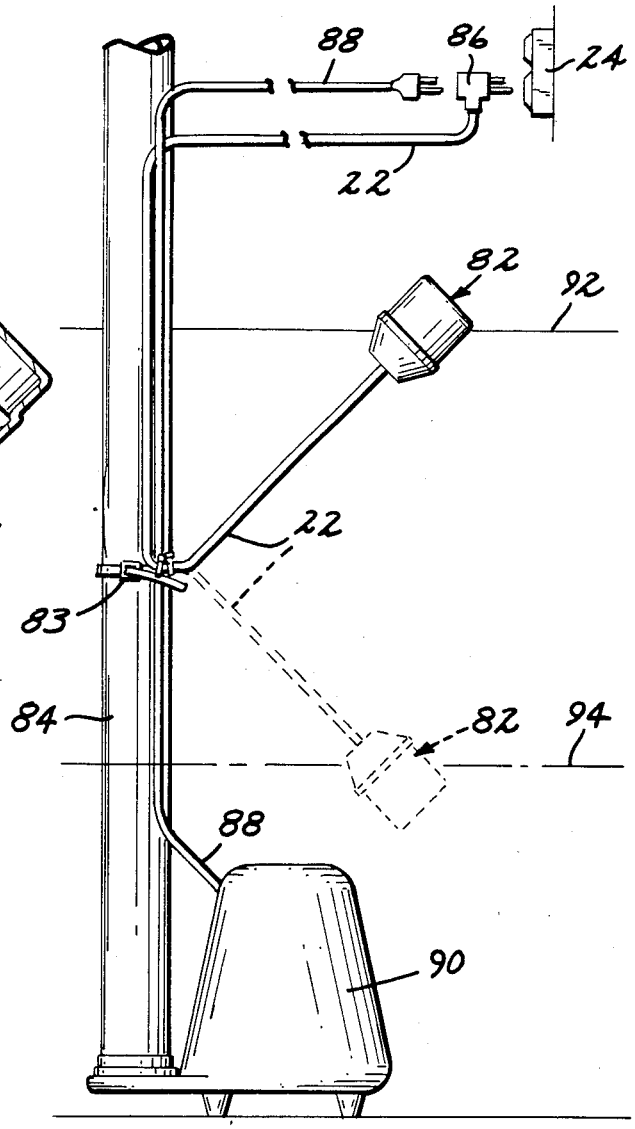
FIG. 1 is an elevational view illustrating one application of a mercury switch in accordance with the principles of the present invention.
Figure 3:
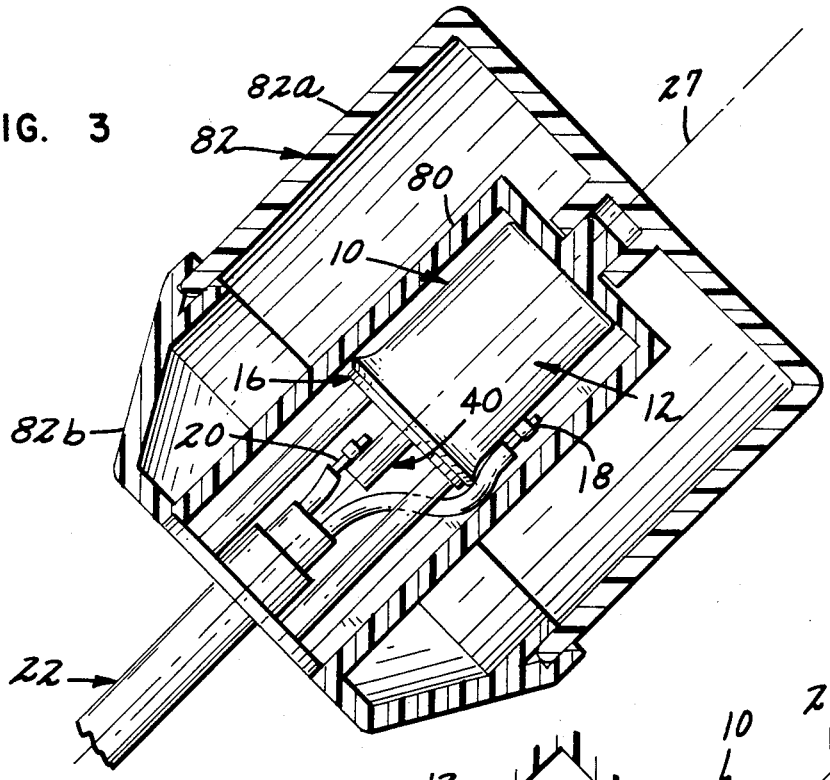
FIG. 3 is an enlarged sectional view with portions shown in elevation illustrating a mercury switch in accordance with the principles of the present invention mounted in the float housing shown in FIG. 1.
Figure 4:
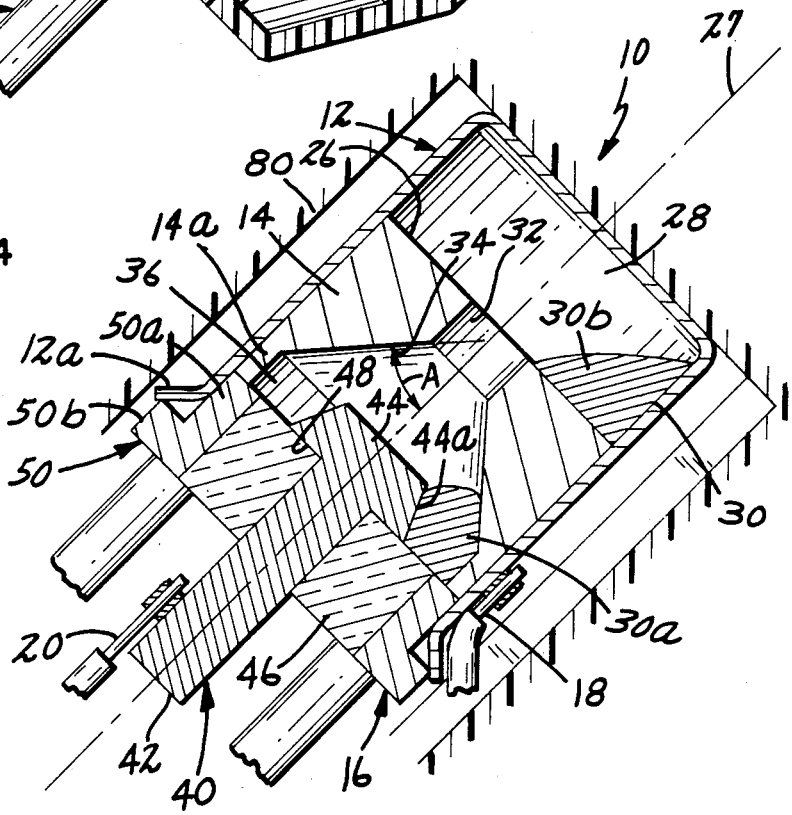
FIG. 4 is an enlarged cross section of a preferred embodiment of a mercury switch embodying the principles of the present invention.

Illustrated in FIG. 1 is a typical application of a mercury switch embodying the principles of the present invention while FIG. 2 is representative of a prior art mercury switch. FIG. 3 is an enlarged cross sectional view of the float housing used in the application shown in FIG. 1, with the mercury switch being shown in side elevation mounted within the float housing. A preferred embodiment of the mercury switch of the present invention, generally designated by the reference numeral 10, is illustrated in FIG. 4. (The preferred embodiment of the improved mercury switch invention which is the subject of this continuation-in-part application is disclosed in FIGS. 5 and 6.) As illustrated in the preferred embodiment, the mercury switch includes an outer metal, preferably steel housing 12 having an open end and a closed end. An electrically conductive baffle member 14 is coaxially mounted inside of the housing 12 intermediate of the open and closed ends thereof, the baffle member 14 making electrical contact with the housing 12. An electrode assembly 16 is partially inserted coaxially into the open end of the housing 12 so as to effectively close off the open end of the housing 12 and form a gas tight seal. The housing 12 in cooperation with the baffle member 14 forms a first electrode of the mercury switch while the electrode assembly 16 forms a second electrode of the mercury switch 10, each of the electrodes being suitably interconnected to electrical leads 18 and 20 which in turn are fed through a cord 22 to a suitable power source, such as a conventional outlet 24 as illustrated in FIG. 1.

As illustrated in FIG. 4, the baffle member 14 defines a substantially flat surface 26 extending transversely of a longitudinal axis 27 of the housing 12. The end surface 26 of the baffle 14 is spaced from the closed end of the housing 12 so as to define a cavity 28 which serves as a reservoir for containing a supply of mercury 30. The baffle member 14 further defines a first cylindrical bore 32 in communication with the reservoir 28 and a second conical bore 34 of increasing diameter in a direction toward the open end of the housing 12. The baffle member 14 further includes an annular collar portion 14*a* which defines a cylindrical bore 36 of substantially greater diameter than the first cylindrical bore. The first, second, and third bores 32, 34, and 36 respectively are contiguous so as to define a continuous pathway from the cavity or reservoir 28 to the electrode assembly 16 at the open end of the housing 12. The angle A of inclination of the walls of the second bore 34 with respect to the longitudinal axis 27 of the housing 12 is approximately forty-one (41) degrees in the preferred embodiment. The electrode assembly 16 includes a one piece solid electrode 40, which in a preferred embodiment might be made of a nickel alloy, having a stem portion 42 and a head portion 44. The head portion 44 has a truncated conical configuration of decreasing diameter in a direction toward the closed end of the housing 12. The head portion 44 extends coaxially from the third bore 36 defined by the baffle member collar portion 14*a* partially into the second bore 34 of the baffle member 14. The head portion 44 has a lesser diameter than the third cylindrical bore 36 and that portion of the second bore 34 into which it extends.

A resilient, cylindrical insulating member 46 is circumferentially positioned around the stem portion 42 along an axial portion thereof. The insulating member 46 abuts against a shoulder portion 48 of the head portion 44 and has a greater diameter than the head portion 44. An L-shaped metal weld ring member 50, preferably made from cold rolled steel is positioned circumferentially about the insulating member 46. The metal weld ring member 50 is fixedly interconnected to the housing by such methods as resistance welding or the like. Further as illustrated in FIG. 4, the housing 12 includes at the open end thereof a tapered or flaired portion 12*a* which in the preferred embodiment is tapered at approximately a forty-five (45) degree angle with respect to the longitudinal axis. The L-shaped metal weld ring member 50 is configured to be inserted along a first portion 50*a* partially into the housing 12 and also make connection at a second portion 50*b* with the flange portion 12*a* of the housing 12 where the metal weld ring member 50 is welded.

FIG. 4 illustrates the mercury switch 10 in an on position. As illustrated, only a partial quantity 30*a* of the mercury flows from the cavity 28 into the bores 34 and 36 of the baffle member 14 when the mercury switch 12 is angled into the on position. The back end surface 26 of the baffle 14 functions as a wall holding back a second quantity 30*b* of mercury. The fact that only a portion of the mercury is utilized to provide electrical contact between the baffle member 14 and the solid electrode 40 enables the mercury 30*a* to be constantly mixed with mercury 30*b* in the cavity or reservoir 28, thereby reducing the effects of contamination caused by multiple switching, and thereby increasing the life of the mercury switch. A variation of the "switch-on" angle can be effected by varying the amount of mercury fill. For example, the following mercury fill volumes with one particular configuration of the mercury switch will provide the following "switch-on" angles:

0.68 cc mercury=switch on angle of approximately 35

0.47 cc mercury=switch on angle of approximately 45

0.36 cc mercury=switch on angle of approximately 55

0.28 cc mercury=switch on angle of approximately 65

Of course the angles will also vary depending on the particular configuration of the cavity.

As further illustrated in FIG. 4, the mercury 30*a* providing the electrical contact between the head portion 44 and the baffle member 14, both of which might be made from a steel alloy, initially contacts the head portion 44 at a forward edge location 44*a* removed from the insulating member 46. Furthermore, the mercury 30*a* is made to conform so as to engage a relatively large area of the baffle member 14 and the head portion 44 once settled in the on position. This is due to the cooperation between the head portion 44 and the baffle member 14. As illustrated, the spacing between the head portion 44 and the walls of the conical bore 34 decreases in a direction toward the closed end of the housing 12 since as previously mentioned, the walls of the second bore 34 have an angle A of inclination of approximately forty-one (41) degrees in the preferred embodiment while the walls of the head portion 44 have an angle of inclination of approximately twenty-two (22) degrees. The reduced space between the head portion 44 and baffle member 14 causes the mercury 30*a* to be compressed, causing its outer surface to engage more of the head portion 44 and baffle member 14. The collar portion 14*a* assists in keeping the initial mercury contact point with the head portion 44 at the forward edge 44*a* away from the insulating member 46, which in the preferred embodiment is a glass insulator. Since the contact arc point is a slight distance away from the glass insulator, erosion of the insulator is drastically reduced thereby increasing the switch life without the added cost of a ceramic arc barrier. In addition, the configuration of the head portion 44 and the baffle member 14 cooperate to break the circuit from insulating member 46 at the forward edge 44*a* of the head portion 44 after the mercury 30*a* has begun moving away from the electrode head portion 44. As the mercury 30*a* moves toward the closed end of the housing 12 it is compressed or squeezed between the forward edge 44*a* and the walls of the second bore 34 to assure continuous contact until the contact is broken. Since mercury has a tendency to be cohesive, the entire mass of mercury 30*a* will stay together and cleanly break from the forward edge 44*a*, wherein it will flow to the cavity or reservoir 28 to mix in with the remaining mercury 30*b*.

The baffle member 14 configuration, and the electrode assembly 16 cooperate to provide an area that is the correct space for the volume of mercury 30*a* that spills over through the bore 32 of the baffle member 14 so as to provide electrical contact between the head portion 44 and the baffle member 14 and the metal weld ring 50. This configuration consistently directs the mercury 30*a* to stay in one integral mass while it is breaking, contacting and moving to and from the cavity or reservoir 28.

Typical dimensions for a preferred embodiment of the present invention is a housing length, including the weld ring member 50 which projects slightly beyond the housing 12, of 1.140 inches while the housing outside diameter is 0.740 inches. The baffle member 14 has an overall length of 0.540 inches and an outside diameter of 0.692 inches. The collar portion 14*a* has a thickness of 0.030 inches and a length 0.090 inches. The applicant has found that in a mercury switch having the basic configuration as described the collar should have a thickness or width from 0.02 inches to 0.04 inches. If the collar portion 14*a* is too thick, the mercury switch 14 has a tendency to stick on. However, if the collar portion 14*a* is not thick enough, the contact between the mercury 30*a* and the head portion 44 will be too close to the insulating member 46. In addition, the collar portion 14*a* provides an abutment surface 14*b* to enable proper alignment of the electrode assembly 16. The length of the collar portion 14*a* should be between 0.070 inches and 0.110 inches for efficient operation. When the collar portion 14*a* has a length less than this it has a tendency to cause improper turn off, and when the collar portion 14*a* has a length greater than this it has a tendency to cause improper turn on.

The length of the first bore 32 through the baffle member 14 determines how uniform the mercury flows from the cavity or reservoir 28 to the electrode assembly 16. In the preferred embodiment, the inside diameter of the first bore 32 is 0.250 inches and the length of the first bore 32 should preferably be 0.20 inches to 0.30 inches and more preferably 0.225 inches so as to work well in a turn on operating range of 35 degrees to 65 degrees depending on the amount of mercury fill.

Also in the preferred embodiment, the solid electrode 40 has a diameter of 0.350 inches at the base of the conical head portion 44 and a diameter of 0.250 inches at the end of the truncated head portion 44 facing the closed end of the housing. The head portion 44 will preferably have a length of 0.125 inches. Preferably the stem portion will have an outside diameter of approximately 0.156 inches. The insulating member 46 will preferably have an outside diameter of 0.500 inches and a length of 0.235 inches. Since the head portion 44, and the insulating member 46 are mounted nearly flush with open end of the housing 12, extending only slightly beyond the open end of housing 12, the head portion will project approximately 0.325 inches into the housing 12. The L-shaped weld ring member 50 will preferably have an outside diameter of 0.682 inches along the portion 50*a*.

The solid electrode 40 will provide a longer useful life as it will not be subject to burn-out as quickly as a hollow electrode, as found in the prior art device shown and represented by the reference numeral 60 in FIG. 2. Additionally, as illustrated in FIG. 2, the electrode 60 is generally spherical in configuration thereby providing contact between the electrode and the mercury 62 at a location relatively close to the insulator 64. As previously mentioned, this increases the rate of erosion of the insulating member 46. Furthermore as illustrated in FIG. 2, the prior art device has a slanted baffle wall 66 adjacent a mercury reservoir 68 which causes all of the mercury 62 to flow through from the reservoir 68 into the area of the baffle and the electrode 60 such that no mixing of the mercury occurs. Also as illustrated in FIG. 2, the prior art device requires that an electrical lead 70 be suitably connected to the electrode head portion 60 so as to provide for electrical interconnection with a power source.

Figure 5:
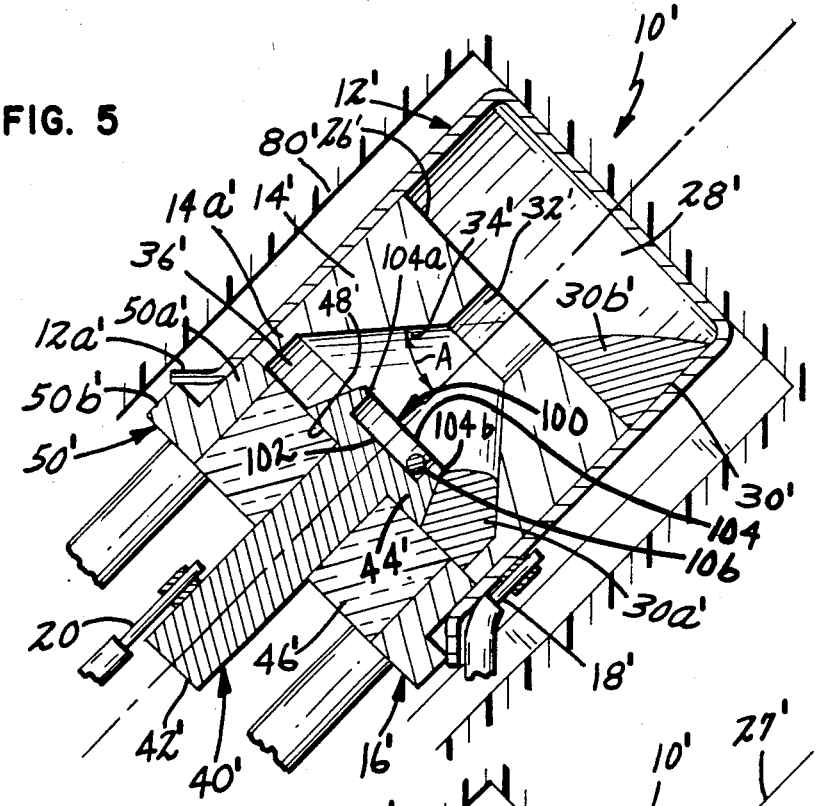
FIG. 5 is a view similar to FIG. 4 of an alternate embodiment of a mercury switch embodying the principles of the present invention; and, FIG. 6 is a view of the switch of FIG. 5 shown with initial contact being made with the mercury in the mercury reservoir.
Figure 6:
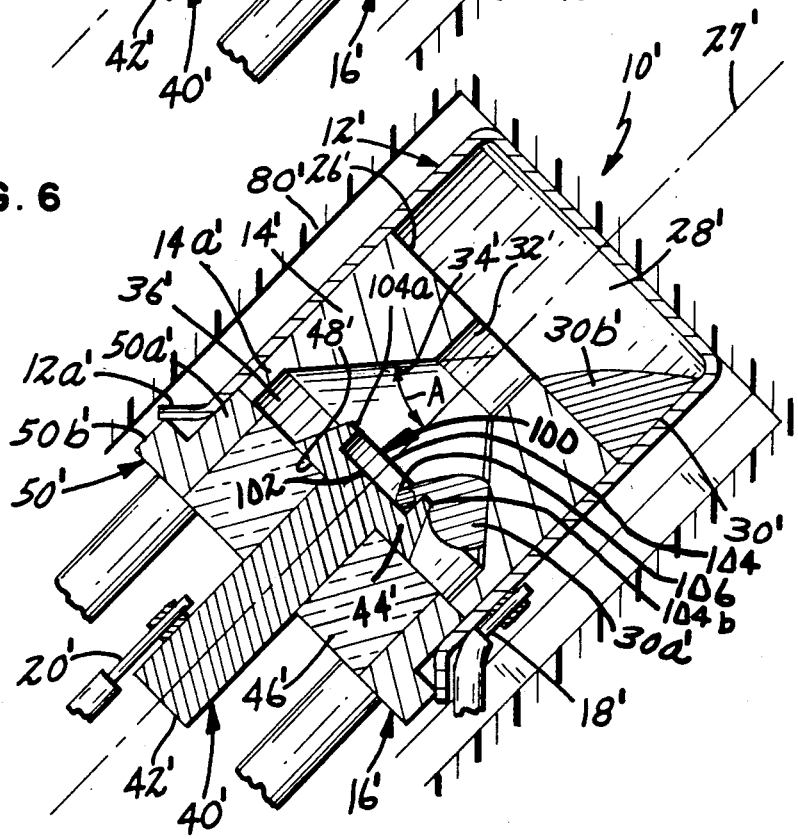

Illustrated in FIGS. 5 and 6 is a preferred embodiment of an improved mercury switch in accordance with the principles of the present invention, primed reference numerals indicating the parts thereof correspond to those of FIG. 4.

In the embodiment shown in FIGS. 5 and 6, the head portion 44' of the electrode 40 has an end portion 100 facing the cavity 28'. The end portion 100 includes a recessed, substantially flat end surface 102 coaxially surrounded by a collar portion 104 extending toward the cavity 28 so as to form a mercury wetting reservoir. After being switched on and off a few times, a quantity of mercury 106 will be deposited or wetted onto the end surface 102 due to arcing at the electrode 40'. Preferably, the electrode 40' is made from a nickel alloy composed of 52% nickel and has a very clean end surface 102 where little oxidation has occurred. The collar portion 104 must be of a narrow width to prevent a substantial amount of mercury wetting from occurring on the end 104*a* of the collar portion 104 which might otherwise interfere with the switch off operation and yet wide enough to prevent the collar portion 104 from being burned through after extended use. Accordingly, the mercury wetting is limited primarily to the mercury wetting reservoir. Further, the recessed, substantially flat end surface 102 must be shallow enough to enable the partial quantity of mercury 30*a'*, which travels into the bores 34' and 36' of the baffle 14' when the mercury switch 10' is angled into the on position, to make contact with the mercury 106 on the end surface 102. On the other hand, the recessed, substantially flat end surface 102 must be deep enough to enable the collar portion 104 to separate the mercury wetted on the end surface 102 from the partial quantity of mercury 30*a'* after the initial contact is made when switching to the on position. Once a certain amount of mercury 106 has been wetted or deposited onto the end surface 102, little or no additional wetting will occur as arcing is minimized. In the preferred embodiment, the inside walls of the collar portion 104 are substantially vertical and the end surface 102 is substantially flat such that the mercury wetting occurs near the inside wall of the collar portion 104. The applicant has found that where the head portion 44' has a width of 0.250 inches, the end surface preferably has a diameter of 13/64 inch to 7/32 inch and a depth of 0.025 inch to 0.060 inch.

As illustrated in FIG. 6, initial contact is made by the quantity of mercury 30*a'* between the mercury 106 on the end surface 102 and the inside wall of the baffle member 14' when the switch 10' is angled into the on position. As the mercury 30*a'* continues to move past the collar portion 104 and into the bore 36' of the baffle member 14', the contact between the mercury 106 and the mercury 30*a'* is broken by the collar portion 104 such that a mercury-to-metal contact is provided at the electrode as illustrated in FIG. 5. It will be appreciated that an initial mercury-to-mercury contact is thus provided at the electrode 40' as the mercury switch 10' is moved into the on position. This results in low contact resistance. Further, due to the cohesive nature of mercury, a very quick and positive contact is made with little or no intermittent contact or bounce occurring. Consequently, less arcing occurs which lessens the internal heat and wear on the switch thereby resulting in a switch with a longer useful life.

As the switch 10' is angled into the off position, the mercury-to-metal contact at the electrode 40' is broken at the forward, outer edge 104*b* of the collar 104. This will insure a break in the electrical contact.

The present invention per the above description of a preferred embodiment thus provides a hybrid type of switch which provides initial mercury-to-mercury contact at the electrode 40' when moved into the on position and a metal-to-mercury contact once in the on position. The cohesive nature of the mercury will provide a quick, clean contact and reduce arcing by providing low contact resistance and continuous contact. This enhances performance and life of the switch 10' since in many applications substantially more current is required when initial contact is made in switching on a load device electrically interconnected to the switch 10' than when switching off the load service. Since the mercury wetting is restricted primarily to the mercury wetting reservoir there is an insignificant amount of mercury wetted at the forward, outer edge 104*b* and the end 104*a* of the collar 104, such that a metal-to-mercury contact is provided at the forward, outer edge 104*b* of the collar 104. When angled to the off position, the metal-to-mercury contact at the forward, outer edge 104*b* of the collar 104 insures that an electrical break in the switch 10' occurs, whereas a mercury-to-mercury contact at the forward, outer edge 104*b* and the end 104*a* of the collar 104 would cause the switch 10' to intermittently stick in the on position.

The present invention is assembled by placing the baffle member into the housing 12. The baffle member is typically press fitted into place. The mercury 30 is then inserted into the housing 12 although it could have been inserted prior to the baffle member 14. The housing 12 and baffle member 14 configuration are then placed in a lower welding tool and the electrode assembly 16 is inserted in an upper weld tool. A vacuum is then created in the housing 12 and the area is back filled with preferably an argon or helium gas, although various inert gases might be utilized at a pressure of approximately twenty-five (25) to two hundred (200) pounds. The upper welding tool presses the electrode assembly 16 into the housing 12 with a force of approximately fifty (50) pounds and resistance welds the weld ring member 50 to the housing flange 12*a*. By pressing the electrode assembly 16 against the baffle member 14, proper positioning of the electrode assembly 16 with respect to the baffle member 14 is assured. The welder nest area is then exhausted and the welder nest is opened for removal of the mercury switch 10.

As illustrated in FIG. 3, in use, the mercury switch 10 might be suitably mounted in a cylindrical carriage 80 which in turn is mounted in a water tight housing 82. As illustrated in FIG. 3, the water tight housing includes two parts 82*a* and 82*b* which are tongue and groove fitted.

As illustrated in FIG. 1, in a typical application the mercury switch 10 contained in its water tight housing or float 82 will be utilized to detect a high or low liquid level. In FIG. 1, the mercury float switch is represented in its off position by the broken lines and in its on position by the solid lines. As illustrated, the electrical cord 22 is adjustably mounted to a support structure such as a water conduit 84 or the like by an adjustable clamp apparatus 83. The electrical cord 22 of the mercury float switch is interconnected to a conventional outlet 24 by a piggyback plug arrangement 86 to which an electrical cord 88 of a pump 90 is also interconnected. Accordingly when the mercury switch is angled to its "switch-on" position which occurs when the water level reaches its high level mark 92, the pump 90 will in turn be activated so as to begin pumping water out through the conduit 84. When the water level reaches a lower mark represented by the reference numeral 94 the mercury switch will be in its "switch-off" position whereupon the pump 90 will be shut off. In yet other applications, the positioning of the mercury switch 10 within the float housing 82 might be reversed or 180 degrees transposed so as to be in its "switch-on" position at the low liquid level and in its "switch-off" position at the high liquid level. Accordingly, the pump 90 will be switched on when the low liquid level is detected by the mercury switch 10. It will be appreciated that the mercury switch of the present invention has utility in many other applications.

Even though numerous characteristics and advantages of the invention have been set forth in the foregoing description, together with details of the structure and function of the invention, the disclosure is illustrative only and changes may be made in detail, especially in matters of shape, size, and arrangement of parts, within the principles of the invention, to the full extent indicated by the broad general meaning of the terms in which the appended claims are expressed.

I claim:

1. A mercury switch; comprising:

(a) an outer metal housing having a closed end and an open end, said housing defining a bore and having a longitudinal axis;

(b) an electrically conductive baffle member coaxially positioned in said housing intermediate said closed and open ends of said housing, said baffle member defining an end facing said closed end of said housing and an end facing said open end of said housing, said baffle member defining a first bore, a second bore of increasing diameter in a direction toward said open end of said housing, and a third bore, said third bore being of a greater diameter than said first bore, said first, second, and third bores being contiguous to define a continuous pathway from the closed end of said housing to the open end of said housing;

(c) an electrode assembly being at least partially inserted coaxially into the bore of said housing at said open end of said housing, said electrode assembly including:

(i) a solid electrode having a stem portion and a head portion, said head portion having an end surface facing said closed end of said housing and having a truncated conical configuration of decreasing diameter in a direction toward said end of said housing, said head portion including a collar portion coaxially surrounding said end surface and extending axially toward said closed end of said housing, said head portion extending from said third bore of said baffle member partially into said second bore of said baffle member, said head portion having a lesser diameter than said third bore of said baffle member and that portion of said second bore into which said head portion projects thereby defining a space between the head portion and the baffle;

(ii) a resilient, insulating member circumferentially positioned about said stem portion along an axial portion thereof, said insulating member abuting said head portion and having a greater diameter than said head portion; and (iii) a weld ring member positioned circumferentially about said insulating member, said metal weld ring member being fixedly interconnected to said housing;

(d) a quantity of mercury; and (e) a cavity positioned between the closed end of said housing and said end of said baffle member facing said closed end of said housing for holding said mercury when said mercury switch is in an off position, said first bore of said baffle member being in communication with said cavity.

2. A mercury switch in accordance with claim 1, wherein said second bore has a conical configuration.

3. A mercury switch in accordance with claim 1, wherein said second bore of said baffle member has walls inclined at an angle of substantially forty-one degrees with respect to the longitudinal axis of the switch.

4. A mercury switch in accordance with claim 1, wherein said metal weld ring member is abuted against said end of said baffle member facing said open end of said housing.

5. A mercury switch in accordance with claim 1, wherein said housing includes a flanged portion flanged outwardly at said open end, said metal weld ring member having an L-shaped configuration for engaging said housing at a location along said flanged portion.

6. A mercury switch in accordance with claim 1, wherein said third bore of said baffle member has a cylindrical configuration and said first bore has a cylindrical configuration.

7. A mercury switch in accordance with claim 1, wherein the space between said head portion of said electrode and said baffle along said second bore decreases in a direction toward said closed end of said housing.

8. A mercury switch in accordance with claim 7, wherein said first bore and said end of said baffle member facing said closed end of said housing cooperate to enable only a first portion of said mercury to flow through said first bore when the mercury switch is tilted to an on position, said first portion of mercury making contact between said head portion of said electrode and said baffle member to enable an electrical circuit therebetween.

9. A mercury switch in accordance with claim 8, wherein said head portion of said electrode and said second and third bores of said baffle member are configured so as to provide initial contact between said head portion and said first portion of mercury at a location removed from said insulating member.

10. A mercury switch, comprising:

(a) a hollow metal housing having a closed end and an open end, said housing having a longitudinal axis extending between said open and closed ends;

(b) an electrically conductive baffle member coaxially positioned in said housing intermediate of said closed end of said housing and said open end of said housing, said baffle member and said housing cooperating to provide a first electrode of the mercury switch, said baffle member defining a first end facing said closed end of said housing and a second end facing said open end of said housing and providing an abutment surface for a metal weld ring member, said baffle member defining a first bore proximate said first end and a second conically configured bore of increasing diameter in a direction toward said open end of said housing and in communication with said first bore, said baffle member including a cylindrical collar portion facing said open end of said housing and defining a third bore;

(c) an electrode assembly extending coaxially through said open end and partially into said housing so as to form a second electrode of the mercury switch, said electrode assembly including, a solid electrode having a stem portion and a head portion, said head portion being closer to said closed end of said housing than said stem portion, said head portion having an end portion facing said closed end of said housing, said end portion having a recessed end surface circumferentially surrounded by a collar portion, a resilient insulating member of greater diameter than said head portion being positioned around said stem portion along an axial portion thereof and abuting against said head portion of said solid electrode, and said metal weld ring member positioned circumferentially about said insulating member and being interconnected to said housing, said head portion having a truncated conical configuration of decreasing diameter in the direction of said closed end of said housing, said head portion being of greater diameter than said stem portion and forming a shoulder surface for abutment thereagainst of said insulating member;

(d) said head portion of said solid electrode projecting from said third bore partially into said second bore, an annular space being defined between said head portion of said solid electrode and said second and third bores, said second bore having walls of greater incline with respect to the longitudinal axis of said housing than said head portion of said electrode whereby said annular space between the walls of said second bore and said head portion becomes less in a direction toward the closed end of said housing; and (e) a reservoir for mercury being defined between the first end of said baffle member and said closed end of said housing, said first bore providing for communication between said reservoir and said second bore, said first end of said baffle member and said first bore cooperating to enable only a first portion of said mercury to pass through said first bore and into said second bore when the mercury switch is tilted to an on position, said first portion of said mercury enabling electrical connection between said head portion and said baffle member at a location along said head portion removed from said insulating member.

11. A mercury switch in accordance with claim 10, wherein the bores of said baffle member are plated with a chrome alloy.

12. A mercury switch in accordance with claim 10, wherein said second electrode is made of a nickel alloy.

13. A mercury switch in accordance with claim 10, wherein said head portion and said stem portion of said solid electrode are a one piece unit.

14. A mercury switch in accordance with claim 10, wherein said baffle member is press fitted into said housing.

15. A mercury switch in accordance with claim 10, wherein said weld ring member is resistance welded to said housing.

* * * * *

UNITED STATES PATENT AND TRADEMARK OFFICE

CERTIFICATE OF CORRECTION

PATENT NO. : 4,572,934

DATED : February 25, 1986

INVENTOR(S) : Stephen P. Johnston

It is certified that error appears in the above-identified patent and that said Letters Patent is hereby corrected as shown below:

Column 2, line 14, "abuting" should be --abutting--;

Column 9, line 4, "service" should be --device--;

Column 10, line 55, "abuting" should be --abutting--;

Column 12, line 14, "abuting" should be --abutting--.

Column 11, line 9, "abuted" should be --abutting--.

Signed and Sealed this

Seventh Day of October, 1986

[SEAL]

*Attest:*

DONALD J. QUIGG

*Attesting Officer*

*Commissioner of Patents and Trademarks*